US010366708B2

(12) United States Patent
Yeo et al.

(10) Patent No.: US 10,366,708 B2
(45) Date of Patent: Jul. 30, 2019

(54) SYSTEMS AND METHODS OF DETECTING SPEECH ACTIVITY OF HEADPHONE USER

(71) Applicant: BOSE CORPORATION, Framingham, MA (US)

(72) Inventors: Xiang-Ern Yeo, Brighton, MA (US); Mehmet Ergezer, Newton, MA (US); Alaganandan Ganeshkumar, North Attleboro, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/463,259

(22) Filed: Mar. 20, 2017

(65) Prior Publication Data

US 2018/0268845 A1 Sep. 20, 2018

(51) Int. Cl.

| | |
|---|---|
| ***H04R 29/00*** | (2006.01) |
| ***G10L 25/78*** | (2013.01) |
| ***H04R 1/10*** | (2006.01) |
| ***H04R 3/00*** | (2006.01) |
| ***G10L 25/21*** | (2013.01) |
| ***G10L 25/51*** | (2013.01) |

(Continued)

(52) U.S. Cl.

CPC ..... *G10L 25/78* (2013.01); *G10L 25/21* (2013.01); *G10L 25/51* (2013.01); *G10L 25/93* (2013.01); *H04R 1/1008* (2013.01); *H04R 1/1041* (2013.01); *H04R 1/406* (2013.01); *H04R 3/005* (2013.01); *G10L 2025/783* (2013.01)

(58) Field of Classification Search

CPC ..... G10L 25/78; G10L 25/21; G10L 25/51; G10L 2025/783; G10L 15/20; H04R 1/1008; H04R 1/1041; H04R 1/406; H04R 3/005; H04M 1/271; H04M 2250/74; G10K 2210/1081

USPC ..... 381/56, 74, 110, 122, 71.6; 704/275, 704/233, 200, 214

See application file for complete search history.

(56) References Cited

U.S. PATENT DOCUMENTS

| | | | |
|---|---|---|---|
| 6,339,706 | B1 | 1/2002 | Tillgren et al. |
| 6,363,349 | B1 | 3/2002 | Urs et al. |
| 6,453,291 | B1 | 9/2002 | Ashley |

(Continued)

FOREIGN PATENT DOCUMENTS

| | | | |
|---|---|---|---|
| EP | 2884763 | A1 | 6/2015 |
| EP | 2914016 | A1 | 9/2015 |

(Continued)

OTHER PUBLICATIONS

Gillett, P.W. "Head Mounted Microphone Arrays" (2009), Blacksburg, VA. Retrieved from the Internet: https://vtechworks.lib.vt.edu/bitstream/handle/10919/28867/GillettDissertation2.pdf?sequence=1&isAllowed=y.

(Continued)

*Primary Examiner* — Norman Yu

(74) *Attorney, Agent, or Firm* — Lando & Anastasi, LLP

(57) ABSTRACT

A headphone system is provided that includes a left and right earpiece having a left and right microphone, respectively, to receive left and right acoustic signals and provide left and right signals for processing. The left and right signals are added to provide a principal signal, and the left and right signals are subtracted to provide a reference signal. A detection circuit compares the principal signal to the reference signal and selectively indicates whether a user is speaking.

11 Claims, 7 Drawing Sheets

(51) Int. Cl.
*H04R 1/40* (2006.01)
*G10L 25/93* (2013.01)

(56) References Cited

U.S. PATENT DOCUMENTS

| | | | | |
|---|---|---|---|---|
| 7,103,550 | B2 | 9/2006 | Gallagher et al. | |
| 7,412,070 | B2 | 8/2008 | Kleinschmidt et al. | |
| 8,184,822 | B2 | 5/2012 | Carreras et al. | |
| 8,611,560 | B2 * | 12/2013 | Goldstein | H04R 25/50 381/110 |
| 8,620,650 | B2 | 12/2013 | Walters et al. | |
| 8,625,819 | B2 | 1/2014 | Goldstein et al. | |
| 8,626,246 | B2 | 1/2014 | Shostak | |
| 8,798,283 | B2 | 8/2014 | Gauger, Jr. et al. | |
| 8,805,692 | B2 | 8/2014 | Goldstein | |
| 8,880,396 | B1 | 11/2014 | Laroche et al. | |
| 9,066,167 | B2 | 6/2015 | Goldstein et al. | |
| 9,076,447 | B2 | 7/2015 | Nandy et al. | |
| 9,204,214 | B2 | 12/2015 | Usher et al. | |
| 9,401,158 | B1 | 7/2016 | Yen et al. | |
| 9,843,861 | B1 | 12/2017 | Termeulen | |
| 2005/0152559 | A1 * | 7/2005 | Gierl | G10L 21/0208 381/71.12 |
| 2007/0172079 | A1 | 7/2007 | Christoph | |
| 2008/0031475 | A1 | 2/2008 | Goldstein | |
| 2009/0304188 | A1 * | 12/2009 | Mejia | H04R 25/407 381/23.1 |
| 2010/0028134 | A1 | 2/2010 | Slapak et al. | |
| 2010/0086122 | A1 | 4/2010 | Takada | |
| 2011/0211706 | A1 | 9/2011 | Tanaka et al. | |
| 2012/0020480 | A1 | 1/2012 | Visser et al. | |
| 2012/0057722 | A1 | 3/2012 | Osako et al. | |
| 2014/0081644 | A1 | 3/2014 | Usher et al. | |
| 2014/0093091 | A1 * | 4/2014 | Dusan | H04R 1/1083 381/74 |
| 2014/0095157 | A1 | 4/2014 | Usher et al. | |
| 2014/0119557 | A1 | 5/2014 | Goldstein | |
| 2014/0119558 | A1 | 5/2014 | Goldstein | |
| 2014/0119559 | A1 | 5/2014 | Goldstein | |
| 2014/0119574 | A1 | 5/2014 | Goldstein | |
| 2014/0122073 | A1 | 5/2014 | Goldstein | |
| 2014/0122092 | A1 | 5/2014 | Goldstein | |
| 2014/0123008 | A1 | 5/2014 | Goldstein | |
| 2014/0123009 | A1 | 5/2014 | Goldstein | |
| 2014/0123010 | A1 | 5/2014 | Goldstein | |
| 2014/0126729 | A1 | 5/2014 | Heiman et al. | |
| 2014/0172421 | A1 | 6/2014 | Liu et al. | |
| 2014/0244273 | A1 | 8/2014 | Laroche et al. | |
| 2014/0268016 | A1 | 9/2014 | Chow et al. | |
| 2014/0278393 | A1 | 9/2014 | Ivanov et al. | |
| 2014/0350943 | A1 | 11/2014 | Goldstein | |
| 2015/0104031 | A1 | 4/2015 | Park et al. | |
| 2015/0112689 | A1 | 4/2015 | Mandy et al. | |
| 2015/0139428 | A1 | 5/2015 | Reining et al. | |
| 2015/0230026 | A1 | 8/2015 | Eichfeld et al. | |
| 2015/0334484 | A1 | 11/2015 | Usher et al. | |
| 2016/0019907 | A1 | 1/2016 | Buck et al. | |
| 2016/0019909 | A1 | 1/2016 | Shi et al. | |
| 2016/0088391 | A1 | 3/2016 | Usher et al. | |
| 2016/0098921 | A1 | 4/2016 | Qutub et al. | |
| 2016/0162469 | A1 | 6/2016 | Santos | |
| 2016/0165361 | A1 | 6/2016 | Miller et al. | |
| 2016/0189220 | A1 | 6/2016 | Verma | |
| 2016/0196818 | A1 | 7/2016 | Christoph | |
| 2016/0196838 | A1 | 7/2016 | Rossum et al. | |
| 2016/0210051 | A1 | 7/2016 | Qutub et al. | |
| 2016/0241948 | A1 | 8/2016 | Liu et al. | |
| 2016/0267899 | A1 | 9/2016 | Gauger, Jr. et al. | |
| 2017/0214800 | A1 | 7/2017 | Nagai | |
| 2017/0263267 | A1 | 9/2017 | Dusan et al. | |

FOREIGN PATENT DOCUMENTS

| | | | |
|---|---|---|---|
| EP | 3007170 | A1 | 4/2016 |
| WO | 2009132646 | A1 | 11/2009 |
| WO | 201694418 | A1 | 6/2016 |
| WO | 2016089745 | A1 | 6/2016 |

OTHER PUBLICATIONS

International Search Report and Written Opinion in application No. PCT/US2018/023136 dated Jul. 26, 2018.

International Search Report and Written Opinion in application No. PCT/US2018/035040 dated Aug. 27, 2018.

International Search Report and Written Opinion in PCT/US2018/023072 dated Jun. 6, 2018.

* cited by examiner

SYSTEMS AND METHODS OF DETECTING SPEECH ACTIVITY OF HEADPHONE USER

BACKGROUND

Headphone systems are used in numerous environments and for various purposes, examples of which include entertainment purposes such as gaming or listening to music, productive purposes such as phone calls, and professional purposes such as aviation communications or sound studio monitoring, to name a few. Different environments and purposes may have different requirements for fidelity, noise isolation, noise reduction, voice pick-up, and the like. In some environments or in some applications it may be desirable to detect when the user of the headphones or headset is actively speaking.

SUMMARY OF THE INVENTION

Aspects and examples are directed to headphone systems and methods that detect voice activity of a user. The systems and methods detect when a user is actively speaking, while ignoring audible sounds that are not due to the user speaking, such as other speakers or background noise. Detection of voice activity by the user may be beneficially applied to further functions or operational characteristics. For example, detecting voice activity by the user may be used to cue an audio recording, to cue a voice recognition system, activate a virtual personal assistant (VPA), trigger automatic gain control (AGC), acoustic echo processing or cancellation, noise suppression, sidetone gain adjustment, or other voice operated switch (VOX) applications. Aspects and examples disclosed herein may improve headphone use and reduce false-triggering by noise or other people talking by targeting voice activity detection of the wearer of the headphones.

According to one aspect, a headphone system is provided and includes a left and right earpiece, a left microphone is coupled to the left earpiece to receive a left acoustic signal and to provide a left signal derived from the left acoustic signal, a right microphone is coupled to the right earpiece to receive a right acoustic signal and to provide a right signal derived from the right acoustic signal, and a detection circuit is coupled to the left microphone and the right microphone and is configured to compare a principal signal to a reference signal, the principal signal derived from a sum of the left signal and the right signal and the reference signal derived from a difference between the left signal and the right signal, and to selectively indicate that the user is speaking based at least in part upon the comparison.

In some examples the detection circuit is configured to indicate the user is speaking when the principal signal exceeds the reference signal by a threshold. In some examples the detection circuit is configured to compare the principal signal to the reference signal by comparing a power content of each of the principal signal and the reference signal.

According to some examples the principal signal and the reference signal are each band filtered.

In certain examples at least one of the left microphone and the right microphone comprises a plurality of microphones and the respective left signal or right signal is derived from the plurality of microphones, at least in part, as a combination of outputs from one or more of the plurality of microphones.

Some examples further include a rear microphone coupled to either earpiece and positioned to receive a rear acoustic signal, the rear acoustic signal being toward the rear of the user's head relative to either or both of the left acoustic signal and the right acoustic signal, and the detection circuit is further configured to compare a rear signal derived from the rear microphone to at least one of the left signal and the right signal to generate a rear comparison, and to selectively indicate that the user is speaking further based upon the rear comparison. In further examples the detection circuit may indicate the user is speaking when the principal signal exceeds the reference signal by a first threshold and the at least one of the left signal and the right signal exceeds the rear signal by a second threshold.

According to another aspect, a headphone system is provided and includes an earpiece, a front microphone coupled to the earpiece to receive a first acoustic signal, a rear microphone coupled to the earpiece to receive a second acoustic signal, the second acoustic signal being toward the rear of a user's head relative to the first acoustic signal, and a detection circuit coupled to the front and rear microphones and configured to compare a front signal derived from the front microphone to a rear signal derived from the rear microphone, and to selectively indicate that the user is speaking based at least in part upon the comparison.

In some examples the detection circuit is configured to indicate the user is speaking when the front signal exceeds the rear signal by a threshold. In some examples the detection circuit is configured to compare the front signal to the rear signal by comparing a power content of each of the front signal and the rear signal.

In certain examples the front and rear signals are band filtered.

According to some examples the front microphone comprises a plurality of microphones and the front signal is derived from the plurality of microphones, at least in part, as a combination of outputs from one or more of the plurality of microphones.

Some examples include a second earpiece, a second front microphone coupled to the second earpiece to receive a third acoustic signal, and a second rear microphone coupled to the second earpiece to receive a fourth acoustic signal, the fourth acoustic signal being toward the rear of the user's head relative to the third acoustic signal. In these examples the detection circuit is further configured to perform a second comparison comprising comparing a second front signal derived from the second front microphone to a second rear signal derived from the second rear microphone, and to selectively indicate that the user is speaking based at least in part upon the first comparison and the second comparison.

Some examples include a second earpiece and a third microphone coupled to the second earpiece to receive a third acoustic signal and provide a third signal, and the detection circuit is further configured to combine the third signal with a selected signal, the selected signal being one of the front signal and the rear signal, determine a difference between the third signal and the selected signal, perform a second comparison comprising comparing the combined signal to the determined signal, and selectively indicate that the user is speaking based at least in part upon the second comparison.

According to another aspect, a method of determining that a headphone user is speaking is provided and includes receiving a first signal derived from a first microphone, receiving a second signal derived from a second microphone, providing a principal signal derived from a sum of the first signal and the second signal, providing a reference signal derived from a difference between the first signal and the second signal, comparing the principal signal to the reference signal, and selectively indicating that a user is speaking based at least in part upon the comparison.

In some examples, comparing the principal signal to the reference signal comprises comparing whether the principal signal exceeds the reference signal by a threshold. In some examples, comparing the principal signal to the reference signal comprises comparing a power content of each of the principal signal and the reference signal.

Some examples include filtering at least one of the first signal, the second signal, the principal signal, and the reference signal.

In certain examples the first signal is derived from a plurality of first microphones at least in part as a combination of outputs from one or more of the plurality of first microphones.

Some examples further include receiving a third signal derived from a third microphone, comparing the third signal to at least one of the first signal and the second signal to generate a second comparison, and selectively indicating that the user is speaking based at least in part upon the second comparison.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the invention. In the figures, identical or nearly identical components illustrated in various figures may be represented by a like numeral. For purposes of clarity, not every component may be labeled in every figure. In the figures.

DETAILED DESCRIPTION

Figure 1:
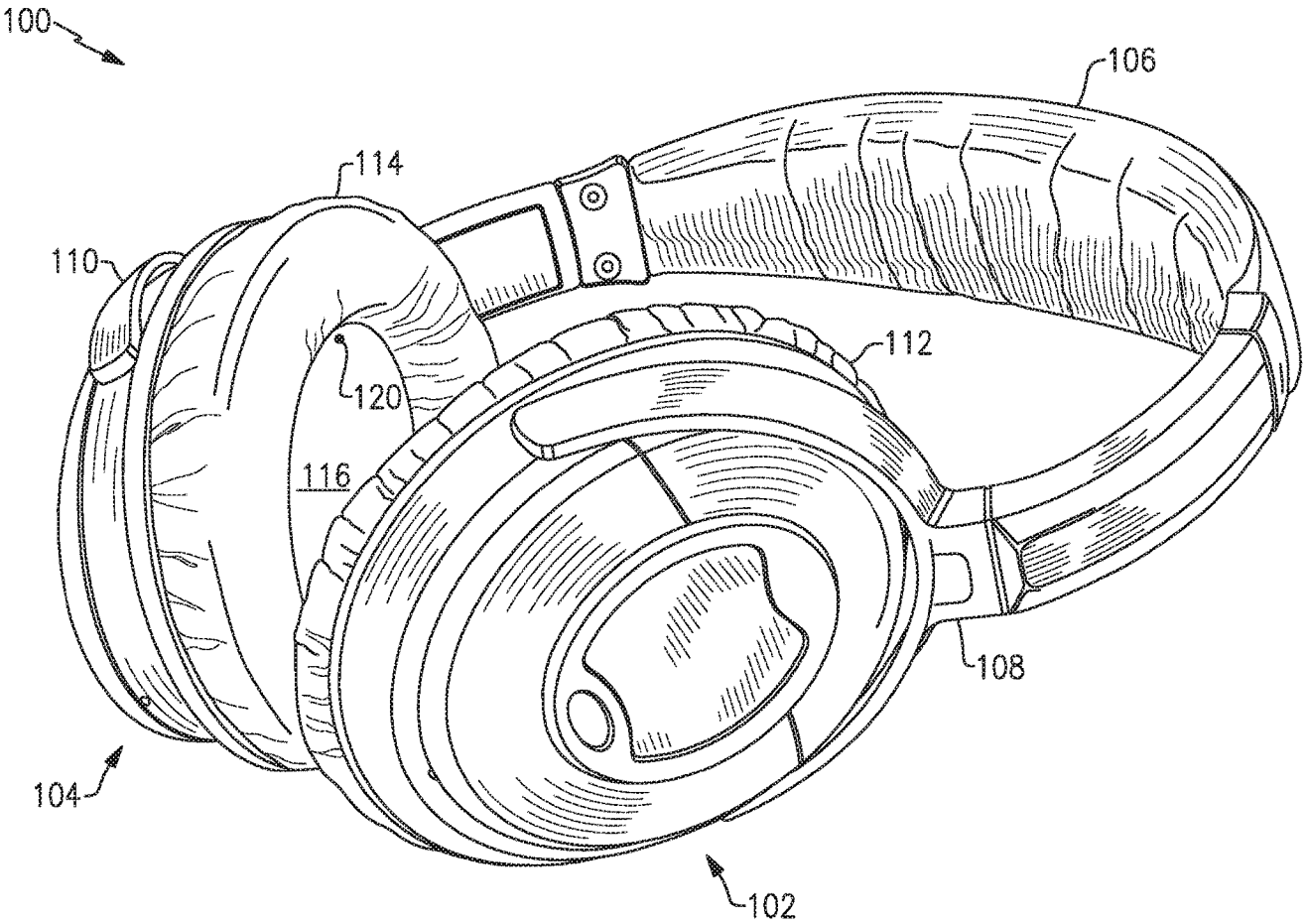
FIG. 1 is a perspective view of a headphone set.

Aspects of the present disclosure are directed to headphone systems and methods that detect voice activity by the user (e.g., wearer) of a headphone set. Such detection may enhance voice activated features or functions available as part of the headphone set or other associated equipment, such as a cellular telephone or audio processing system. Examples disclosed herein may be coupled to, or placed in connection with, other systems, through wired or wireless means, or may be independent of any other systems or equipment.

The headphone systems disclosed herein may include, in some examples, aviation headsets, telephone headsets, media headphones, and network gaming headphones, or any combination of these or others. Throughout this disclosure the terms "headset," "headphone," and "headphone set" are used interchangeably, and no distinction is meant to be made by the use of one term over another unless the context clearly indicates otherwise. Additionally, aspects and examples in accord with those disclosed herein, in some circumstances, may be applied to earphone form factors (e.g., in-ear transducers, earbuds), and are therefore also contemplated by the terms "headset," "headphone," and "headphone set." Advantages of some examples include low power consumption while monitoring for user voice activity, high accuracy of detecting the user's voice, and rejection of voice activity of others.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

It is to be appreciated that examples of the methods and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

FIG. 1 illustrates one example of a headphone set. The headphones 100 include two earpieces, e.g., a right earcup 102 and a left earcup 104, coupled to a right yoke assembly 108 and a left yoke assembly 110, respectively, and intercoupled by a headband 106. The right earcup 102 and left earcup 104 include a right circumaural cushion 112 and a left circumaural cushion 114, respectively. Visible on the left earcup 104 is a left interior surface 116. While the example headphones 100 are shown with earpieces having circumaural cushions to fit around or over the ear of a user, in other examples cushions may sit on the ear, or may include earbud portions that protrude into a portion of a user's ear canal, or may include alternate physical arrangements. As discussed in more detail below, each of the earcups 102, 104 include one or more microphones, such as one or more front microphones, one or more rear microphones, and/or one or more interior microphones. Although the example headphones 100 illustrated in FIG. 1 include two earpieces, some examples may include only a single earpiece for use on one side of the head only. Additionally, although the example headphones 100 illustrated in FIG. 1 include a headband 106, other examples may include different support structures to maintain one or more earpieces (e.g., earcups, in-ear structures, etc.) in proximity to a user's ear, e.g., an earbud may include a shape and/or materials configured to hold the earbud within a portion of a user's ear.

Figure 2:
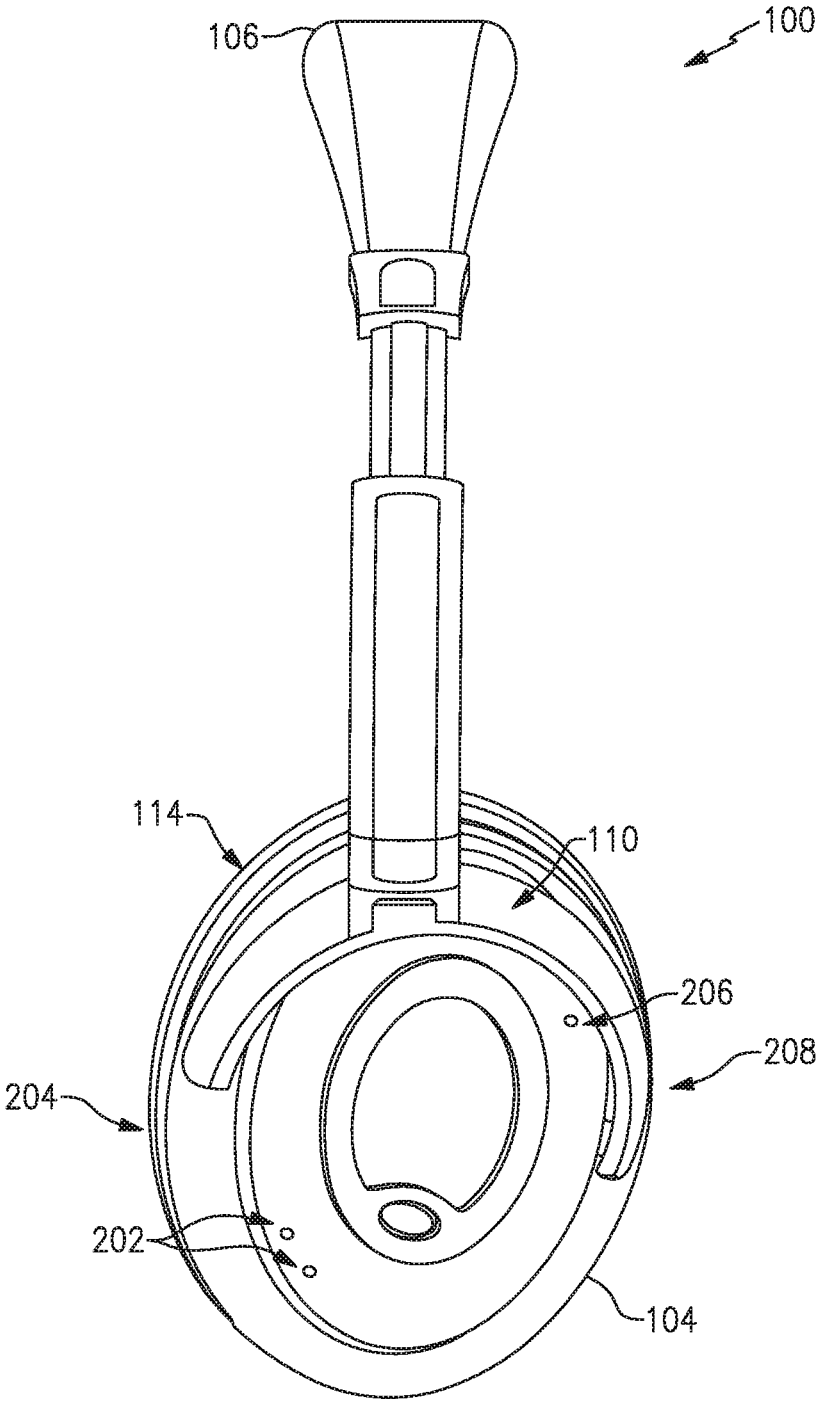
FIG. 2 is a left-side view of a headphone set.

FIG. 1 and FIG. 2 illustrate multiple example placements of microphones, any one or more of which may be included in certain examples. FIG. 1 illustrates an interior microphone 120 in the interior of the left earcup 104. In some examples, an interior microphone may additionally or alternatively be included in the interior of the right earcup 102, either earcup may have multiple interior microphones, or neither earcup may have an interior microphone. FIG. 2 illustrates the headphones 100 from the left side and shows details of the left earcup 104 including a pair of front microphones 202, which may be nearer a front edge 204 of the earcup, and a rear microphone 206, which may be nearer a rear edge 208 of the earcup. The right earcup 102 may additionally or alternatively have a similar arrangement of front and rear microphones, though in examples the two earcups may have a differing arrangement in number or placement of microphones. Additionally, various examples may have more or fewer front microphones 202 and may have more, fewer, or no rear microphones 206. While the reference numerals 120, 202, and 206 are used to refer to one or more microphones, the visual element illustrated in the figures may, in some examples, represent an acoustic port wherein acoustic signals enter to ultimately reach the microphones 120, 202, 206, which may be internal and not physically visible from the exterior. In examples, one or more of the microphones 120, 202, 206 may be immediately adjacent to the interior of an acoustic port, or may be removed from an acoustic port by a distance, and may include an acoustic waveguide between an acoustic port and an associated microphone.

Various microphone signals will be processed in various ways to detect whether a user of the headphones 100, i.e., a person wearing the headphones, is actively speaking. Detection of a user speaking will sometime be referred to as voice activity detection (VAD). As used herein, the terms "voice," "speech," "talk," and variations thereof are used interchangeably and without regard for whether such speech involves use of the vocal folds.

Examples disclosed herein to detect user voice activity may operate or rely on various principles of the environment, acoustics, vocal characteristics, and unique aspects of use, e.g., an earpiece worn or placed on each side of the head of a user whose voice activity is to be detected. For example, in a headset environment, a user's voice generally originates at a point symmetric to the left and right sides of the headset and will arrive at both a right front microphone and a left front microphone with substantially the same amplitude at substantially the same time and substantially the same phase, whereas background noise and vocalizations of other people will tend to be asymmetrical between the left and right, having variation in amplitude, phase, and time. Additionally, a user's voice originates in a near-field of the headphones and will arrive at a front microphone with more acoustic energy than it will arrive at a rear microphone. Background noise and vocalizations of other people originating farther away may tend to arrive with substantially the same acoustic energy at front and rear microphones. Further, background noise and vocalizations from people that originate farther away than the user's mouth will generally cause acoustic energy received at any of the microphones to be at a particular level, and the acoustic energy level will increase when the user's voice activity is added to these other acoustic signals. Accordingly, a user's voice activity will cause an increase in average acoustic energy at any of the microphones, which may be beneficially used to apply a threshold to voice activity detection. Various spectral characteristics can also play a beneficial role in detecting a user's voice activity.

Figure 3:
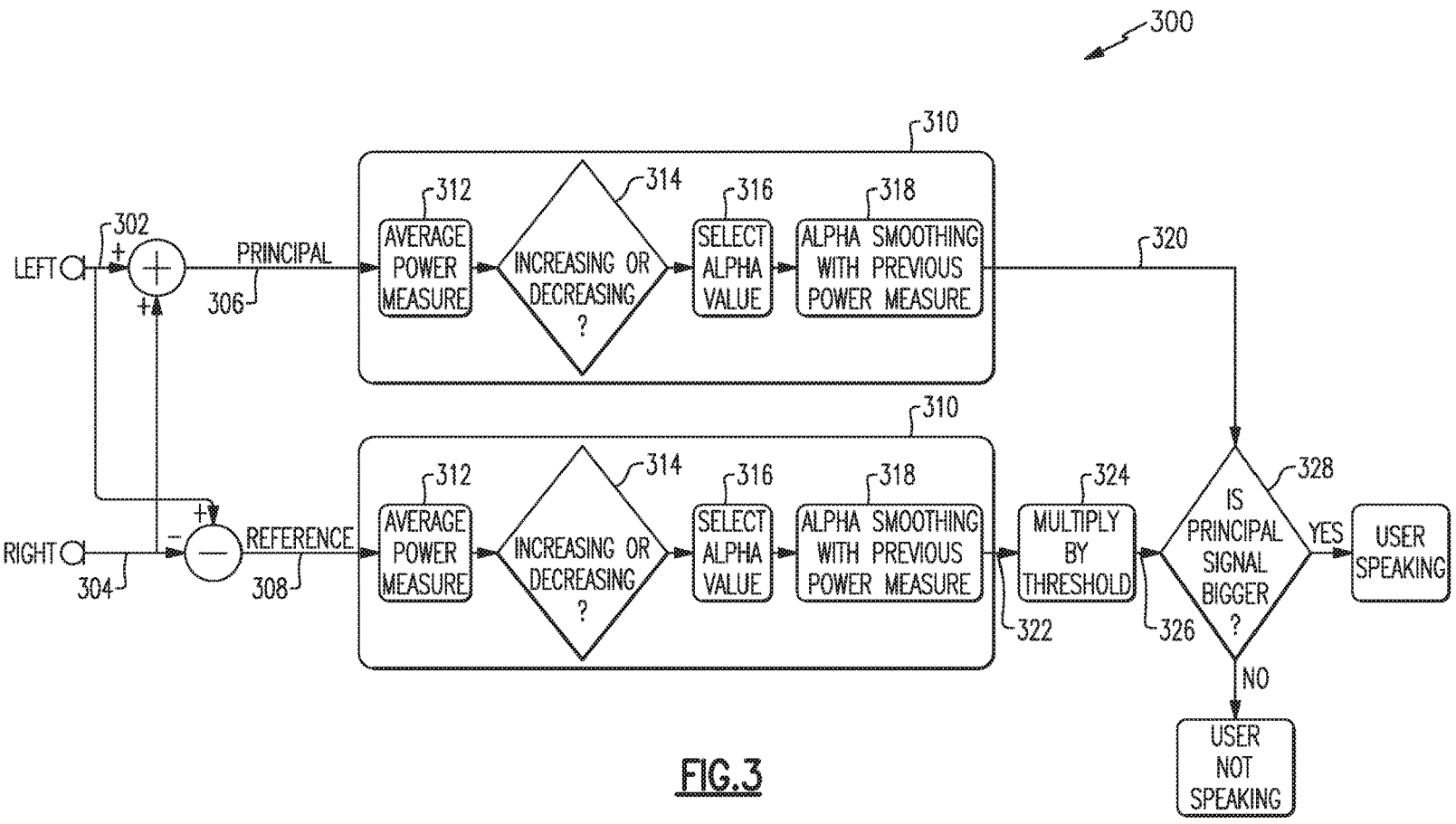
FIG. 3 is a flow chart of an example method to compare signal energy to detect voice activity.

FIG. 3 illustrates a method 300 of processing microphone signals to detect a likelihood that a headphone user is actively speaking. The example method 300 shown in FIG. 3 relies on processing and comparing characteristics of binaural, i.e., left and right, signals. As discussed above, left and right vocal signals due to the user's voice are substantially symmetric with each other and may be substantially identical due to the substantially equidistant position of left and right microphones from the user's mouth. The method of FIG. 3 processes a left signal 302 and a right signal 304 by adding them together to provide a principal signal 306. The method of FIG. 3 also processes the left signal 302 and the right signal 304 by subtracting them to provide a reference signal 308. The left and right signals 302, 304 are each provided by, and received from, microphones on the left and right sides of the headphones, respectively, and may come from multiple microphones on each side. For example, a left side may have one microphone or may have multiple microphones, as discussed above, and the left signal 302 may be provided by a single microphone on the left side or may be a combination of signals from multiple microphones on the left side. In the case of multiple microphones on the left side, the left signal 302 may be provided from a steered beam formed by processing the multiple microphones, e.g., as a phased array, or may be a simple combination (e.g., addition) of signals from the multiple microphones, or may be provided through other signal processing. Similarly, the right signal 304 may be provided by a single microphone, a combination of multiple microphones, or an array of microphones, all on the right side.

As discussed above, the left signal 302 and the right signal 304 are added together to provide a principal signal 306, and the right signal 304 is subtracted from the left signal 302 to provide a reference signal 308. Alternatively the left signal 302 may instead be subtracted from the right signal 304 to provide the reference signal 308. If the user of the headphones is talking, the user's voice will be substantially equal in both the left signal 302 and the right signal 304. Accordingly, the left signal 302 and the right signal 304 constructively combine in the principal signal 306. In the reference signal 308, however, the user's voice may substantially cancel itself out in the subtraction, i.e., destructively interferes with itself. Accordingly, when the user is talking, the principal signal 306 will include a user voice component with approximately double the signal energy of either of the left signal 302 or the right signal 304 individually; while the reference signal 308 will have substantially no component from the user's voice. This allows a comparison of the principal signal 306 and the reference signal 308 to provide an indication whether the user is talking.

Components of the left signal 302 and the right signal 304 that are not associated with the user's voice are unlikely to be symmetric between the left and right sides and will tend neither to reinforce nor interfere with each other, whether added or subtracted. In this manner, the principal signal 306 and the reference signal 308 will have approximately the same signal energy for components that are not associated with the user's voice. For example, signal components from surrounding noise, other talkers at a distance, and other talkers not equidistant from the left and right sides, even if nearby, will be of substantially the same signal energy in the principal signal 306 and the reference signal 308. Substantially, the reference signal 308 provides a reference of the surrounding acoustic energy not including the user's voice, whereas the principal signal 306 provides the same components of surrounding acoustic energy but also includes the user's voice when the user is talking. Accordingly, if the principal signal 306 has sufficiently more signal energy than the reference signal 308, it may be concluded that the user is talking.

With continued reference to FIG. 3, each of the principal signal 306 and the reference signal 308 are processed through a smoothing algorithm 310. The smoothing algorithm 310 may take many forms, or may be absent altogether in some examples, and the details of the smoothing algorithm 310 shown in FIG. 3 merely represent one example of a smoothing algorithm. The example smoothing algorithm 310 of FIG. 3 generates a slowly-changing indicator of average energy/power content of an input signal, e.g., the principal signal 306 or the reference signal 308. At least one benefit of a smoothing algorithm is to prevent sudden changes in the acoustic environment from causing an erroneous indication that the user is talking. The smoothing algorithm 310 processes the signals to measure a power of each signal, at block 312, and calculates a decaying weighted average of each signal's power measurements over time, at block 318. The weighted average of current and previous power measurements may be based upon some characteristic value, e.g., an alpha value or time constant, selected at block 316, that impacts the weighting, and the selection of the alpha value may be dependent upon whether the current power measure is increasing or decreasing, determined at block 314. The smoothing algorithm 310 acting upon each of the principal signal 306 and the reference signal 308 provides a principal power signal 320 and a reference power signal 322, respectively.

In certain examples, the principal signal 306 may be directly compared to the reference signal 308, and if the principal signal 306 has larger amplitude a conclusion is made that the user is talking. In other examples, the principal power signal 320 and the reference power signal 322 are compared, and a determination that the user is talking is made if the principal power signal 320 has larger amplitude. In certain examples, a threshold is applied to require a minimum signal differential, to provide a confidence level that the user is in fact talking. In the example method 300 shown in FIG. 3, a threshold is applied by multiplying the reference power signal 322 by a threshold value at block 324. For example, a certain confidence level may be had that the user is talking if the principal power signal 320 is at least 8% higher than the reference power signal 322, and in such case the reference power signal 322 may be multiplied by 1.08 at block 324 to provide a threshold power signal 326. The principal power signal 320 is then compared to the threshold power signal 326 at block 328. If the principal power signal 320 is higher than the threshold power signal 326 it is determined that the user is talking, otherwise it is determined that the user is not talking. Various confidence levels may be selected via selection of a threshold value. For example, in various examples, a threshold value may include any value in a range of 2% to 30%, i.e., various examples test whether the principal power signal 320 is greater than the reference power signal 322 by, e.g., 2% to 30%, which may be achieved by multipliers of, e.g., from 1.02 to 1.30, applied to the reference power signal 322 at block 324 to provide the threshold power signal 326 to the comparison at block 328.

In other examples, the smoothed principal signal 320 may be multiplied by a threshold value (e.g., less than unity) rather than, or in addition to, the reference power signal 322 being multiplied by a threshold value. In certain examples, a comparison between a principal signal and a reference signal in accord with any of the principal and reference signals discussed above may be achieved by taking a ratio of the principal signal to the reference signal, and the ratio may be compared to a threshold, e.g., unity, 1.08, or any of a range of values such as from 1.02 to 1.30, or otherwise. The example method 300 of FIG. 3, however, which multiplies one of the signals by a threshold value prior to a direct comparison, may require less computational power or fewer processing resources than would a method that calculates a ratio and compares the ratio to a fractional threshold.

In certain examples, a method of processing microphone signals to detect a likelihood that a headphone user is actively speaking, such as the example method 300, may include band filtering or sub-band processing. For example, the left and right signals 302, 304 may be filtered to remove frequency components not part of a typical voice or vocal tract range, prior to processing by, e.g., the example method 300. Further, the left and right signals 302, 304 may be separated into frequency sub-bands, and one or more of the frequency sub-bands may be separately processed by, e.g., the example method 300. Either of filtering or sub-band processing, or a combination of the two, may decrease the likelihood of a false positive caused by extraneous sounds not associated with the user's voice. However, either of filtering or sub-band processing may require additional circuit components at additional cost, and/or may require additional computational power or processing resources, therefore consuming more energy from a power source, e.g., a battery. In certain examples, filtering may provide a good compromise between accuracy and power consumption.

The method 300 of FIG. 3 discussed above is an example method of detecting a user's voice activity based on processing and comparison of binaural, i.e., left and right, input signals. An additional method in accord with aspects and examples disclosed herein to detect a user's voice activity involves a front signal and a rear signal. An example method 400 is illustrated with reference to FIG. 4. The example method 400 receives a front signal 402 and a rear signal 404 and compares their relative weighted average power to determine whether a user is speaking.

When a user wearing headphones speaks, acoustic energy from the user's voice will reach a front microphone (on either side, e.g., the left earcup or the right earcup) with greater intensity than it reaches a rear microphone. Many factors influence the difference in acoustic intensity reaching the front microphone versus the rear microphone. For example, the rear microphone is farther away from the user's mouth, and both microphones are located in a near-field region of the user's voice, causing distance variation to have significant effect as the acoustic intensity decays proportional to distance cubed. An acoustic shadow is also created by the user's head and the existence of the earcup and yoke assembly, which further contribute to a lower acoustic intensity arriving at the rear microphone. Acoustic energy from background noise and from other talkers will tend to have substantially the same acoustic intensity arriving at the front and rear microphones, and therefore a difference in signal energy between the front and rear may be used to detect that a user is speaking. The example method 400 accordingly processes and compares the energy in the front signal 402 to the energy in the rear signal 404 in a similar manner to how the example method 300 processes and compares a principal signal 306 and a reference signal 308.

The front and rear signals 402, 404 are each provided by, and received from, front and rear microphones, respectively, on a single side of the headphones, e.g., either the left earcup or the right earcup. For example, a left front signal 402 may come from either front microphone 202 as shown in FIG. 2 (which is a left side view), or may be a combination of outputs from multiple left-side front microphones, or there may be only a single left front microphone. A left rear signal 404 may come from the rear microphone 206 shown in FIG. 2, or a combination (as discussed above) of rear microphones (not shown).

Each of the front signal 402 and the rear signal 404 may be processed by a smoothing algorithm 310, as discussed above, to provide a front power signal 420 and a rear power signal 422, respectively. The rear power signal 422 may optionally be multiplied by a threshold at block 424, similar to the threshold applied at block 324 in the example method 300 discussed above, to provide a threshold power signal 426. The front power signal 420 is compared to the threshold power signal 426 at block 428, and if the front power signal 420 is greater than the threshold power signal 426, the method 400 determines that the user is speaking; otherwise the method 400 determines that the user is not speaking. Certain examples may include variations or absence of the smoothing algorithm 310, as discussed above with respect to the example method 300, and certain examples may include differing approaches to making a comparison, e.g., by calculating a ratio or by application of threshold, similar to such variations discussed above with respect to the example method 300.

Figure 4:
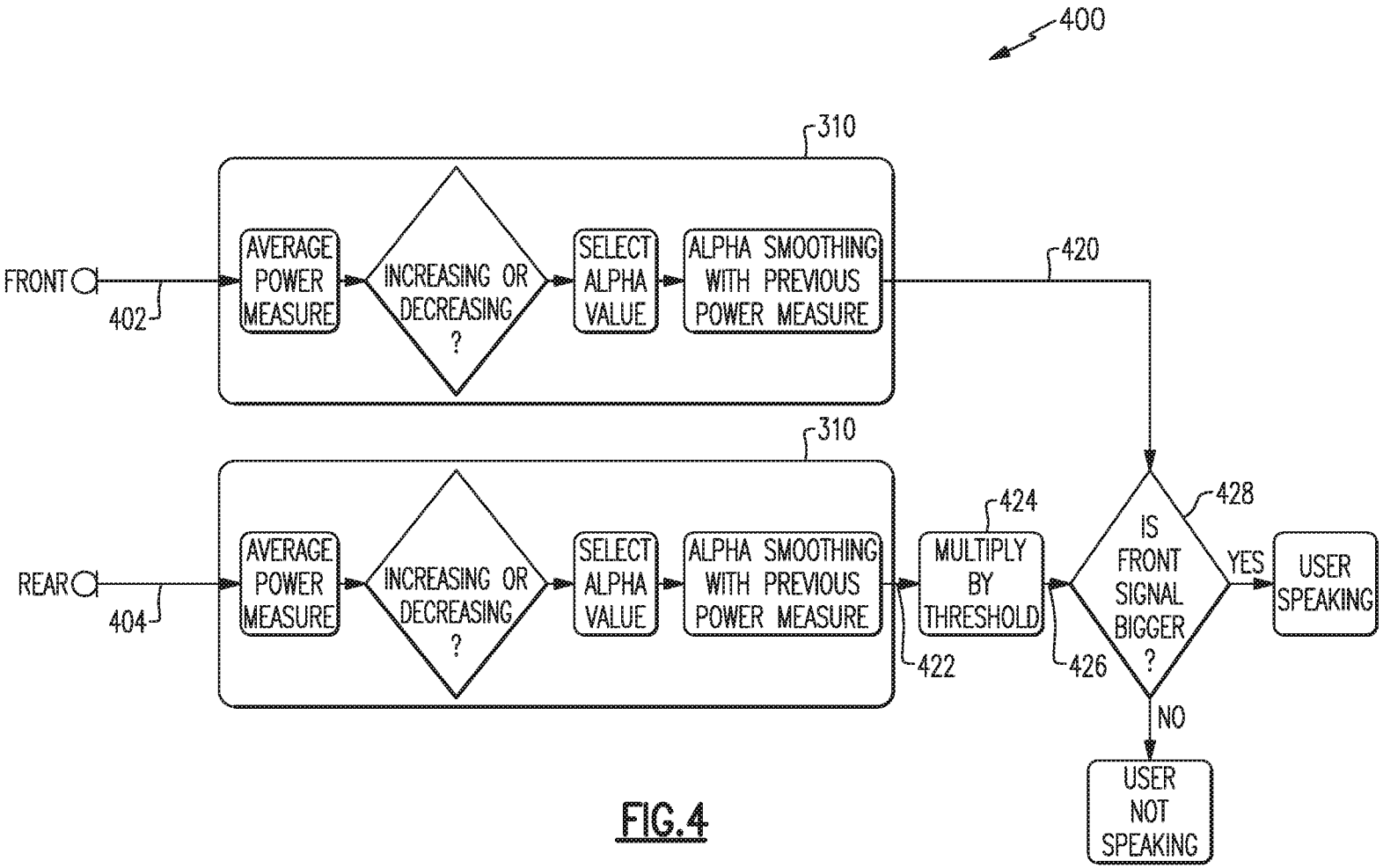
FIG. 4 is a flow chart of another example method to compare signal energy to detect voice activity.

While reference has been made to a number of power signals, e.g., principal and reference power signals 320, 322 and front and rear power signals 420, 422, the signals provided for comparison in the example methods of FIGS. 3-4 may be measures of power, energy, amplitude, or other measurable indicators of signal strength suitable for making comparisons as described or otherwise drawing conclusions as to the user vocal content of the various signals.

One or more of the above described methods, in various examples and combinations, may be used to detect that a headphone user is actively talking, e.g., to provide voice activity detection. Any of the methods described may be implemented with varying levels of reliability based on, e.g., microphone quality, microphone placement, acoustic ports, headphone frame design, threshold values, selection of smoothing algorithms, weighting factors, window sizes, etc., as well as other criteria that may accommodate varying applications and operational parameters. Any example of the methods described above may be sufficient to adequately detect a user's voice activity for certain applications. Improved detection may be achieved, however, by a combination of methods, such as examples of those described above, to incorporate concurrence and/or confidence level among multiple methods or approaches.

Figure 5:
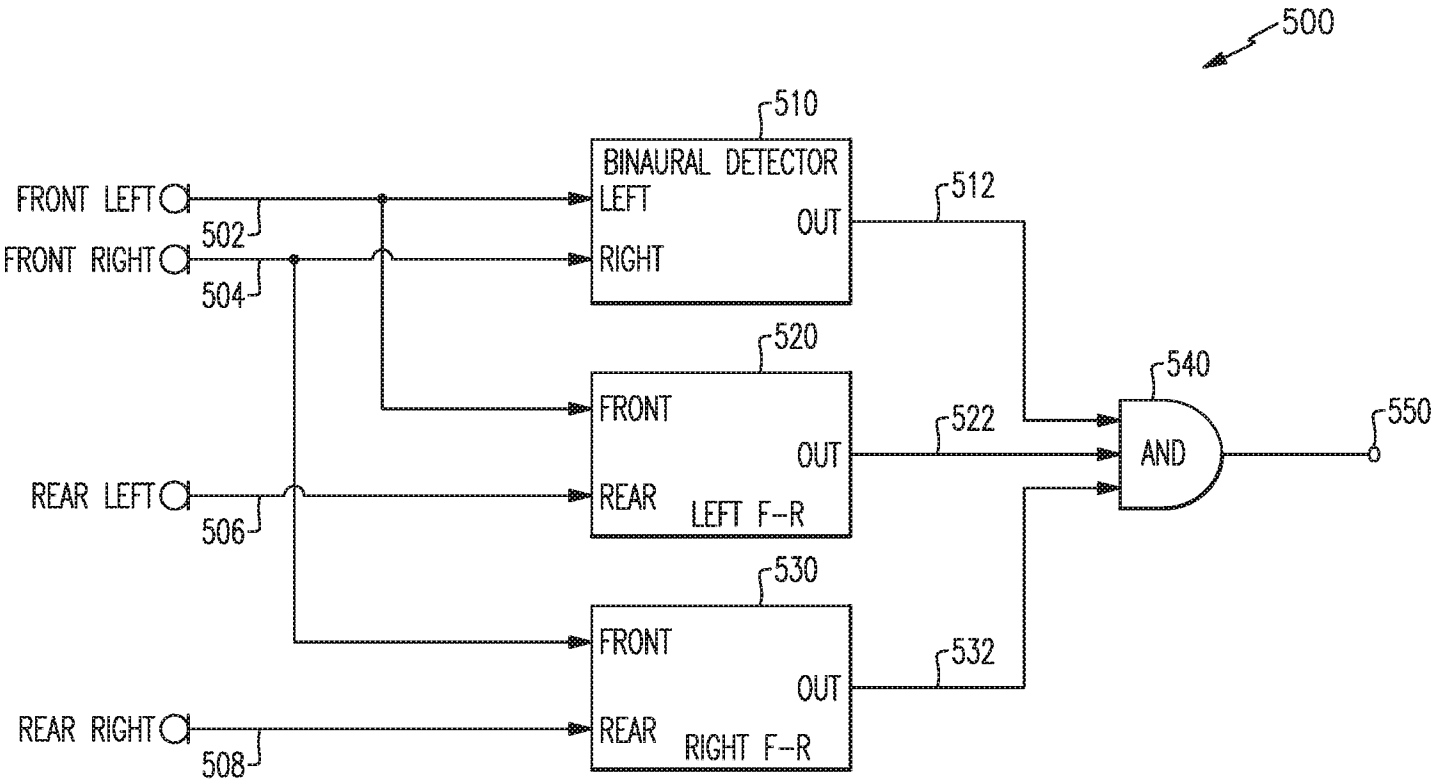
FIG. 5 is a schematic diagram of an example system to detect voice activity.

One example of a combinatorial system 500 for user voice activity detection is illustrated by the block diagram of FIG. 5. The example system 500 of FIG. 5 includes front and rear microphones on each of a left and right side of a headphone set. The microphones provide a left front signal 502, a right front signal 504, a left rear signal 506 and a right rear signal 508. As discussed above, any of the microphones may be a set of multiple microphones whose output signals may be combined in various ways. The left front signal 502 and right front signal 504 may be processed by a binaural detector 510 implementing an example of the binaural detection method exemplified by the method 300 above to produce a binary output 512 indicating user voice activity or not. The left front signal 502 and the left rear signal 506 may be processed by a first front-to-rear detector 520 implementing an example of the front-to-rear detection method exemplified by the method 400 above to produce a binary output 522 indicating user voice activity or not. Similarly, the right front signal 504 and right rear signal 508 may be processed by a second front-to-rear detector 530 implementing an example of front-to-rear detection (exemplified by the method 400 above) to produce a binary output 532 indicating user voice activity or not.

Any of the binary outputs 512, 522, or 532 may reliably indicate user voice activity, but they may be further combined by logic 540 to provide a more reliable combined output 550 to indicate detection of user voice activity. In the example system 500 of FIG. 5, the logic 540 is shown as an AND logic that requires all three binary outputs 512, 522, and 532 to indicate user voice activity to provide a combined output 550 that indicates user voice activity. Other examples may include different combinatorial logic 540. For example, in certain examples the combined output 550 may require only two of the three binary outputs 512, 522, and 532 to indicate user voice activity to provide a combined output 550 that indicates user voice activity. In other examples, one of the binary outputs 512, 522, 532 may have precedence over the other two, i.e., unless the other two agree in a specified result. In examples, there may be differing number or types of detectors (e.g., detectors 510, 520, 530) and there may be more or fewer binary outputs based upon the number and type of detectors included.

Figure 6:
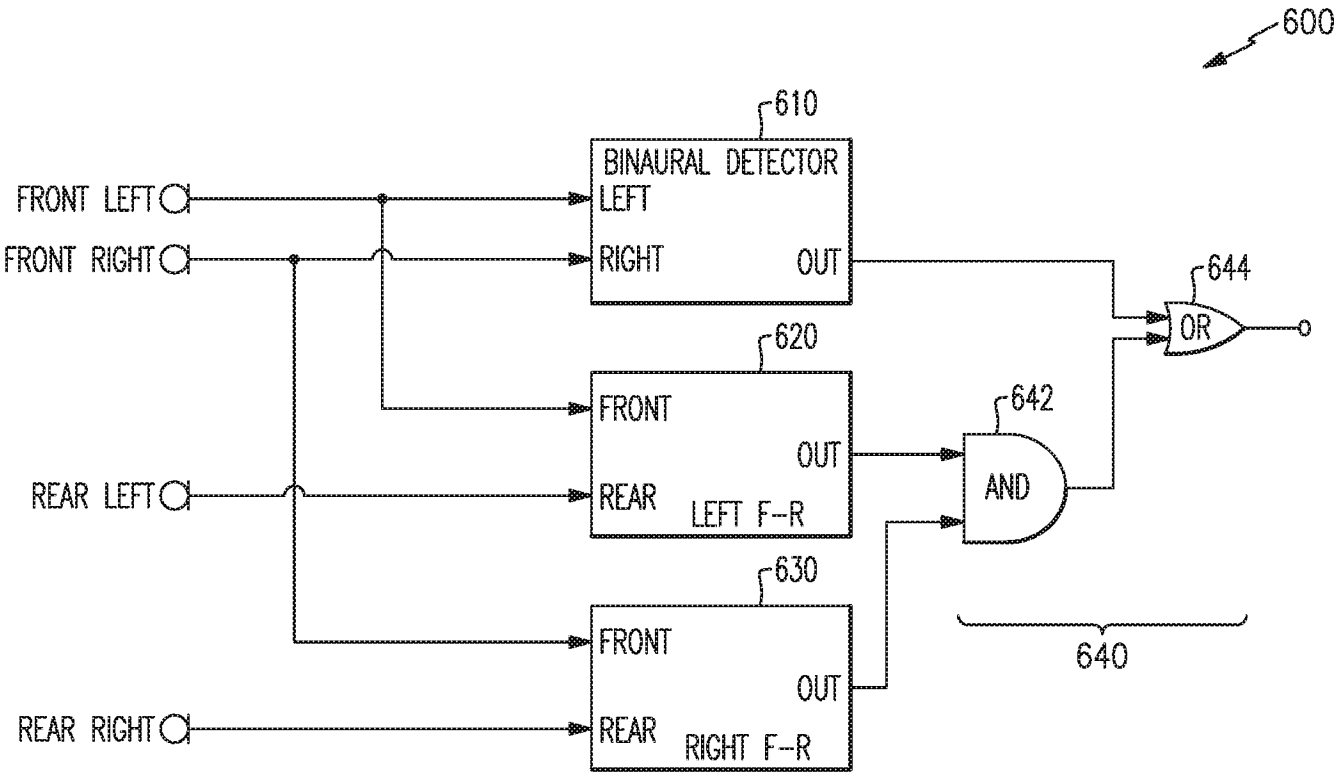
FIG. 6 is a schematic diagram of another example system to detect voice activity.

For example, FIG. 6 illustrates a combinatorial system 600 similar to that of system 500 but including a different combinatorial logic 640. In the example system 600, the combinatorial logic 640 includes AND logic 642 to indicate user voice activity if both the left and right front-to-rear detectors 620, 630 indicate user voice activity, and OR logic 644 to provide an overall combined output 650 to indicate user voice activity if either the binaural detector 610 or the combination of left and right front-to-rear detectors 620, 630 indicate user voice activity.

Additional types of detectors include at least a threshold detector and an interior sound detector. A threshold detector may detect a general threshold sound level, and may provide a binary output to indicate that the general sound level in the vicinity of the headphones is high enough that a user may be talking. Alternately, a threshold detector may indicate that the general sound level has increased recently such that a user may be talking. The binary output of a threshold detector, or any detector disclosed herein, may be taken as an additional input to a combined output 550, or may be used as an enable signal to other detectors. Accordingly, various detectors could remain in an off state or consume lower power so long as a certain detector, e.g., a threshold detector, or combination of detectors, indicates no user voice activity.

An interior sound detector may detect sound levels inside one or both earcups, such as from one or more interior microphones 120 (see FIG. 1) positioned in the interior of an earcup. An interior microphone is especially robust against wind noise and is also robust against other sounds because the interior microphone may be physically isolated from the exterior of the headphones. The signal level of an interior microphone may be monitored to determine if a user is speaking. When a user speaks, the signal at the interior microphone increases due to acoustic conduction through bones, nasal cavity, etc., and the signal level at the interior microphone may be measured and compared to a threshold to determine if a user's voice is present, or to confirm (e.g., enhanced confidence level) determination of voice activity by other detectors.

As discussed above, filtering or sub-band processing may also enhance the operation of a voice activity detection system in accord with aspects and examples described herein. In one example, microphone signals may be filtered to be band-limited to a portion of the spectrum for which a user's head creates a substantial head shadow, i.e., frequencies that will have a significant front-to-rear differential for sounds coming from in front or behind, and a significant left-to-right differential for sounds coming from the side. In certain examples, one or more of the various microphone signals is band-pass filtered to include a frequency band substantially from about 800 Hertz to 2,000 Hertz prior to processing by one or more of the various detectors described herein.

Figure 7:
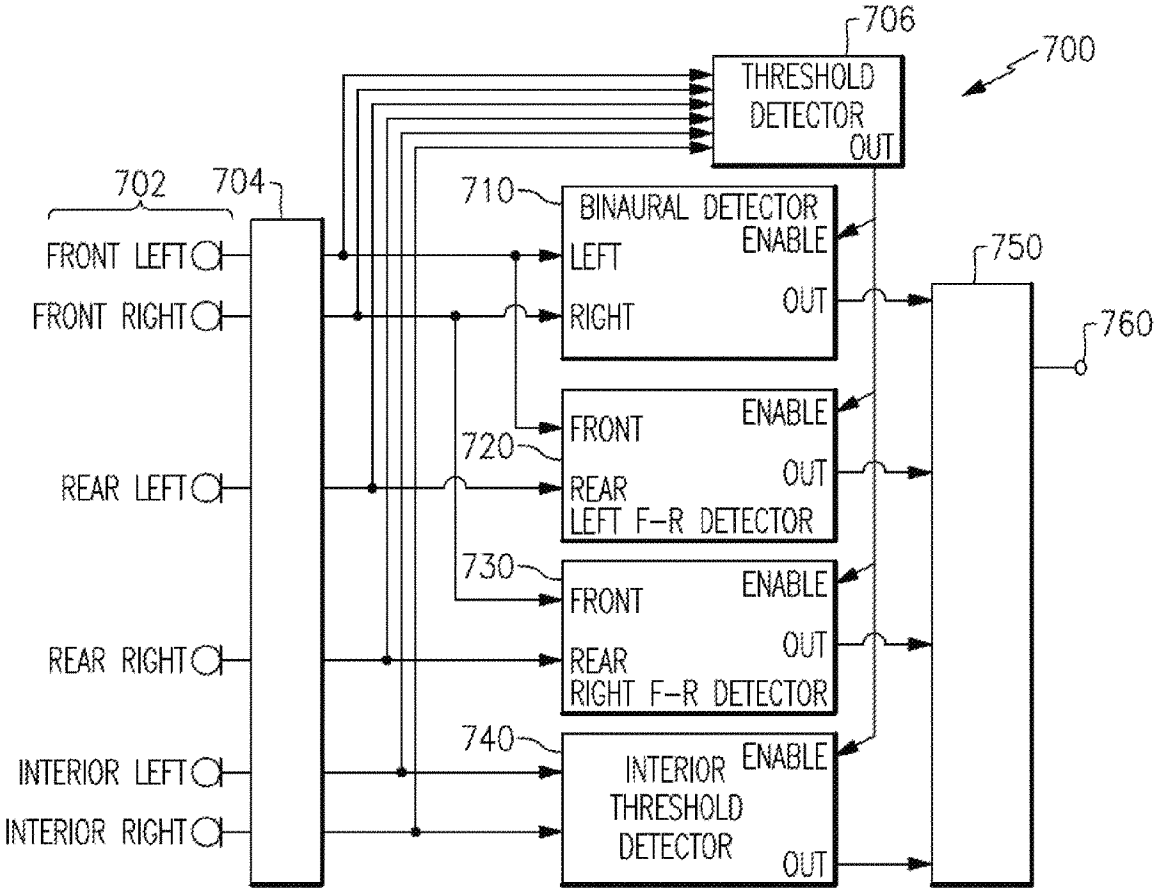
FIG. 7 is a schematic diagram of another example system to detect voice activity.

FIG. 7 illustrates an example of a system 700 incorporating multiple examples of the various detection methods and combinatorial logic discussed above. In the example system 700 there are one or more front, rear, and interior microphones 702 in each of the left and right earcups of a headphone set. Signals from any of the microphones 702 may be processed by a filter 704 to, e.g., remove non-vocal frequency bands, or to limit a frequency range expected to have substantial differentials as discussed above. A threshold detector 706 may monitor any one or more of the microphones 702 and enable any of the detectors 710, 720, 730, and/or 740, when there is sufficient sound level, or change in sound level, that indicate a user may be speaking. As discussed above, a threshold detector may conserve energy because the detectors 710, 720, 730, and/or 740 may remain off whenever the sound environment exhibits characteristics, e.g., lacking spectral content or too quiet, that a user is likely not talking. The binaural detector 710 may be any example of binaural detectors as discussed above, or variations thereof, and the left and right front-to-rear detectors 720, 730, may be any example of front-to-rear detectors as discussed above, or variations thereof. The example system 700 also includes an interior detector 740 that compares one or more signals from one or more of the interior microphones 702 to a threshold level to indicate a likelihood that the user is speaking. Binary outputs from each of the detectors 710, 720, 730, and 740, are provided to a combinatorial logic 750 to provide a combined output 760. It is to be understood that the example system 700 of FIG. 7 is meant to be merely illustrative of an example of a system that incorporates many of the aspects and examples of the systems and methods disclosed herein, and is not presented as a primary or preferred example. Multiple variations of combinatorial logic, number and types of microphones, number and types of detectors, threshold values, filters, etc. are contemplated by examples in accord with systems and methods disclosed herein.

It is to be understood that any of the functions of methods 300, 400, or similar, and any components of the systems 500, 600, 700, or similar, may be implemented or carried out in a digital signal processor (DSP), a microprocessor, a logic controller, logic circuits, and the like, or any combination of these, and may include analog circuit components and/or other components with respect to any particular implementation. Functions and components disclosed herein may operate in the digital domain and certain examples include analog-to-digital (ADC) conversion of analog signals generated by microphones, despite the lack of illustration of ADC's in the various figures. Any suitable hardware and/or software, including firmware and the like, may be configured to carry out or implement components of the aspects and examples disclosed herein, and various implementations of aspects and examples may include components and/or functionality in addition to those disclosed.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A headphone system, comprising:

a left earpiece;

a right earpiece;

a left microphone coupled to the left earpiece to receive a left acoustic signal and to provide a left signal derived from the left acoustic signal;

a right microphone coupled to the right earpiece to receive a right acoustic signal and to provide a right signal derived from the right acoustic signal; and a detection circuit coupled to the left microphone and the right microphone, the detection circuit configured to process both a principal signal and a reference signal through a smoothing algorithm, the principal signal derived from a sum of the left signal and the right signal and the reference signal derived from a difference between the left signal and the right signal, the smoothing algorithm configured to calculate a principal power signal from a decaying weighted average of power of the principal signal over time, to calculate a reference power signal from a decaying weighted average of power of the reference signal over time, and to selectively indicate that the user is speaking based at least in part upon a comparison between the principle power signal and the reference power signal.

2. The headphone system of claim 1 wherein the detection circuit is configured to indicate the user is speaking when the principal power signal exceeds the reference power signal by a threshold.

3. The headphone system of claim 1 wherein the principal signal and the reference signal are each band filtered.

4. The headphone system of claim 1 wherein at least one of the left microphone and the right microphone comprises a plurality of microphones and the respective left signal or right signal is derived from the plurality of microphones, at least in part, as a combination of outputs from one or more of the plurality of microphones.

5. The headphone system of claim 1 further comprising:

a rear microphone coupled to either earpiece and positioned to receive a rear acoustic signal, the rear acoustic signal being toward the rear of the user's head relative to either or both of the left acoustic signal and the right acoustic signal;

the detection circuit further configured to compare a rear signal derived from the rear microphone to at least one of the left signal and the right signal to generate a rear comparison, and to selectively indicate that the user is speaking further based upon the rear comparison.

6. The headphone system of claim 5 wherein the detection circuit indicates the user is speaking when the principal power signal exceeds the reference power signal by a first threshold and the at least one of the left signal and the right signal exceeds the rear signal by a second threshold.

7. A method of determining that a headphone user is speaking, the method comprising:

receiving a first signal derived from a first microphone configured to receive acoustic signals near a left side of the user;

receiving a second signal derived from a second microphone configured to receive acoustic signals near a right side of the user;

providing a principal signal derived from a sum of the first signal and the second signal;

providing a reference signal derived from a difference between the first signal and the second signal;

processing the principal signal through a smoothing algorithm configured to calculate a principal power signal from a decaying weighted average of power of the principal signal over time;

processing the reference signal through the smoothing algorithm to calculate a reference power signal from a decaying weighted average of power of the reference signal over time;

comparing the principal power signal to the reference power signal; and selectively indicating that a user is speaking based at least in part upon the comparison.

8. The method of claim 7 wherein comparing the principal signal to the reference power signal comprises comparing whether the principal power signal exceeds the reference signal by a threshold.

9. The method of claim 7 further comprising filtering at least one of the first signal, the second signal, the principal signal, and the reference signal.

10. The method of claim 7 wherein the first signal is derived from a plurality of first microphones at least in part as a combination of outputs from one or more of the plurality of first microphones.

11. The method of claim 7 further comprising:

receiving a third signal derived from a third microphone;

comparing the third signal to at least one of the first signal and the second signal to generate a second comparison; and selectively indicating that the user is speaking based at least in part upon the second comparison.

* * * * *